US009604342B2

(12) United States Patent
Shibata et al.

(10) Patent No.: US 9,604,342 B2
(45) Date of Patent: Mar. 28, 2017

(54) EYEGLASS LENS PROCESSING APPARATUS

(71) Applicant: NIDEK CO., LTD., Gamagori, Aichi (JP)

(72) Inventors: Ryoji Shibata, Toyokawa (JP); Osamu Tanabe, Tokyo (JP)

(73) Assignee: NIDEK CO., LTD., Aichi (JP)

( * ) Notice: Subject to any disclaimer, the term of this patent is extended or adjusted under 35 U.S.C. 154(b) by 448 days.

(21) Appl. No.: 13/756,834

(22) Filed: Feb. 1, 2013

(65) Prior Publication Data

US 2013/0203322 A1 Aug. 8, 2013

(30) Foreign Application Priority Data

Feb. 3, 2012 (JP) ..... 2012-021603

(51) Int. Cl.
*B24B 49/16* (2006.01)
*B24B 49/00* (2012.01)
*B24B 9/14* (2006.01)

(52) U.S. Cl.
CPC ..... *B24B 49/16* (2013.01); *B24B 9/148* (2013.01); *B24B 49/006* (2013.01)

(58) Field of Classification Search
CPC ..... B23Q 1/64; B24B 9/144; B24B 9/146; B24B 9/148; B24B 27/0069; B24B 41/005; B24B 47/225; B24B 49/006; B24B 49/16
USPC ..... 408/13; 451/5, 8
See application file for complete search history.

(56) References Cited

U.S. PATENT DOCUMENTS

| | | | | |
|---|---|---|---|---|
| 6,045,432 | A * | 4/2000 | Shibata | 451/5 |
| 6,089,957 | A * | 7/2000 | Shibata | 451/41 |
| 6,099,383 | A * | 8/2000 | Mizuno et al. | 451/5 |
| 6,123,604 | A * | 9/2000 | Mizuno et al. | 451/42 |
| 8,241,091 | B2 | 8/2012 | Takeichi | |
| 8,333,636 | B2 | 12/2012 | Takeichi et al. | |
| 8,506,352 | B2 * | 8/2013 | Takeichi et al. | 451/5 |
| 2004/0192170 | A1 * | 9/2004 | Mizun | 451/5 |
| 2008/0248720 | A1 * | 10/2008 | Shibata | 451/5 |
| 2008/0248722 | A1 * | 10/2008 | Takeichi | 451/5 |

(Continued)

FOREIGN PATENT DOCUMENTS

| | | | |
|---|---|---|---|
| EP | 1445065 | A1 | 8/2004 |
| JP | 2004255561 | A | 9/2004 |

(Continued)

OTHER PUBLICATIONS

Communication from the European Patent Office issued Sep. 29, 2014 in a counterpart European Application No. 13000514.3.

*Primary Examiner* — Kenneth M Lo
*Assistant Examiner* — Michael J Huntley
(74) *Attorney, Agent, or Firm* — Sughrue Mion, PLLC

(57) ABSTRACT

In an eyeglass lens processing apparatus, a roughing tool for roughing a periphery of an eyeglass lens cuts the periphery up to a roughing path without rotating an eyeglass lens in a first stage and the roughing tool moves along the roughing path while rotating the eyeglass lens in a second stage. A calculating unit for obtaining control data of the lens rotating unit at the second stage. The calculating unit obtains a first load torque applied to a lens chuck shaft at every rotation angle of the lens based on condition data, and obtains a rotation speed of the lens at which the first load torque per unit time becomes equal to or lower than a predetermined reference value.

14 Claims, 12 Drawing Sheets

(56) References Cited

U.S. PATENT DOCUMENTS

| | | | | |
|---|---|---|---|---|
| 2009/0111358 | A1* | 4/2009 | Nakao | B24B 49/16 451/5 |
| 2010/0197198 | A1* | 8/2010 | Takeichi | 451/5 |
| 2010/0247253 | A1* | 9/2010 | Shibata et al. | 408/3 |
| 2011/0009036 | A1* | 1/2011 | Shibata | 451/255 |
| 2011/0096290 | A1* | 4/2011 | Schneider et al. | 351/177 |
| 2012/0083186 | A1* | 4/2012 | Shibata | 451/5 |
| 2013/0232774 | A1* | 9/2013 | Nakako et al. | 29/650 |
| 2014/0199917 | A1* | 7/2014 | Shibata et al. | 451/5 |

FOREIGN PATENT DOCUMENTS

| | | | |
|---|---|---|---|
| JP | 2006-123073 | A | 5/2006 |
| JP | 2006334701 | A | 12/2006 |

* cited by examiner

EYEGLASS LENS PROCESSING APPARATUS

CROSS REFERENCE TO RELATED APPLICATION

This application is based upon and claims the benefit of priority of Japanese Patent Application No. 2012-021603 filed on Feb. 3, 2012, the contents of which are incorporated herein by reference in its entirety.

BACKGROUND

The present invention relates to an eyeglass lens processing apparatus that processes the peripheral edge of an eyeglass lens.

In processing apparatuses that process a peripheral edge of an eyeglass lens, the eyeglass lens is held by lens chuck shafts, a lens is rotated by the rotation of the lens chuck shafts, and the peripheral edge of the lens is roughed by pressing roughing tools, such as a rough grindstone, against the lens. When the lens chuck shafts are caused to hold the eyeglass lens, a cup that is a jig is fixed to a surface of the lens, the lens is mounted via the cup on a cup holder of one lens chuck shaft of the eyeglass lens processing apparatus, and the lens is chucked by a lens presser member of the other lens chuck shaft.

In recent years, water-repellant lenses with a water-repellant substance that neither water nor oil adheres easily is coated on the surface of the lens have often been used. Since the water-repellant lenses have a slippery surface, if the processing control is performed in the same manner as when processing lenses that are not coated with a water-repellant substance, a problem so-called "axis deviation", that attachment of the cup may slip, and the rotation angle of the lens may deviate with respect to the rotation angle of the lens chuck shafts, is apt to occur.

As a method of reducing this "axis deviation", the technique of detecting a load torque applied to the lens chuck shafts and reducing the lens rotating speed so that the load torque falls within a predetermined value is suggested (refer to JP-A-2004-255561). Additionally, as another method, there is suggested the technique of rotating a lens at a constant speed, and changing the axis-to-axis distance between the lens chuck shafts and a grindstone rotating shaft so that the amount being cut while the lens makes one rotation becomes substantially constant (refer to JP-A-2006-334701).

SUMMARY

A technical object of one aspect of the present invention is to provide an eyeglass lens processing apparatus that effectively suppresses "axis deviation" and can efficiently perform processing.

In order to solve the above objects, the aspect of the invention provides the following configurations.

(1) An eyeglass lens processing apparatus for processing a periphery of an eyeglass lens, the eyeglass lens processing apparatus comprising:

a lens rotating unit configured to rotate a lens chuck shaft for holding the eyeglass lens;

a tool rotating unit configured to rotate a tool spindle to which a roughing tool for roughing the periphery of the eyeglass lens is attached;

a moving unit configured to move the lens chuck shaft relative to the tool spindle;

a controller configured to control the lens rotating unit and the moving unit based on a roughing path for roughing the periphery the periphery of the eyeglass lens by the roughing tool, such that the roughing tool cuts the periphery of the eyeglass lens up to the roughing path without rotating the eyeglass lens in a first stage and the roughing tool moves along the roughing path while rotating the eyeglass lens in a second stage; and a calculating unit configured to calculate control data of the lens rotating unit at the second stage, wherein the calculating unit obtains a first load torque applied to the lens chuck shaft at every rotation angle of the lens based on condition data including the roughing path, thickness at a radial position of the lens around a chuck center of the lens chuck shaft and a diameter of the roughing tool, and obtains a rotation speed of the lens at which the first load torque per unit time becomes equal to or lower than a reference value.

(2) The eyeglass lens processing apparatus according to (1), wherein the calculating unit divides a processing region at every rotation angle of the lens into small regions by a predetermined calculation method, obtains a second load torque at every small region based on the condition data, and obtains the first load torque at every rotation angle of the lens by integrating the obtained second load torque.

(3) The eyeglass lens processing apparatus according to (1), wherein the calculating unit obtains a processing load applied to a force point determined by a predetermined method for the processing region at every rotation angle of the lens, and a direction of the processing load based on the condition data, and obtains the first load torque based on the distance from the chuck center of the lens chuck shafts to the force point, the processing load, and the direction of the processing load.

(4) The eyeglass lens processing apparatus according to (2), wherein the calculating unit obtains an amount of processing at every small region roughed based on the condition data, obtains a processing load that is generated by the rotation of the roughing tool based on the processing amounts, and obtains the second load torque at every small region based on the distance from the chuck center of the lens chuck shafts to the small region, the processing load.

(5) The eyeglass lens processing apparatus according to (1), further comprising:

lens surface shape obtaining unit for obtaining a front surface shape and a rear surface shape of the lens; and a lens external diameter obtaining unit configured to obtain an external diameter of the lens, and wherein the calculating unit obtains the thickness at the radial position of the lens based on the front surface shape and the rear surface shape of the lens obtained by the lens surface shape obtaining unit and the external diameter of the lens obtained by the lens external diameter obtaining unit.

(6) The eyeglass lens processing apparatus according to (5), wherein the lens external diameter obtaining unit includes a storage unit for storing an external diameter which has been set in advance.

(7) The eyeglass lens processing apparatus according to (1) further comprising:

a load detector configured to detect a rotation load applied to the lens by the roughing tool, wherein when the load detected by the load detector exceeds a value set in order to suppress an occurrence of axis deviation, the controller controls the rotating speed of the lens rotating unit so that the rotation load does not exceed the value.

(8) The eyeglass lens processing apparatus according to (1), a load detector configured to detect a rotation load applied to the lens by the roughing tool, wherein when the load detected by the load detector exceeds a value set in order to suppress an occurrence of axis deviation, the controller corrects a rotating speed obtained by the calculating unit by a predetermined method, and controls the lens rotating unit based on the corrected rotating speed.

(9) The eyeglass lens processing apparatus according to (1), wherein the controller controls the lens rotating unit so as not to exceed an upper speed limit set in order to prevent damage of the lens at least in a second half of one rotation of the lens.

(10) The eyeglass lens processing apparatus according to (1), further comprising mode selection unit for selecting a first mode when a water-repellant lens is processed and a second mode when a normal lens is processed, wherein the reference value applied when the second mode is selected is set to be higher than that when the first mode is selected.

According to the invention, the "axis deviation" can be effectively suppressed. Additionally, the "axis deviation" can be suppressed to perform efficient processing.

3B is a front view of a tracing stylus of the lens external diameter detector.

Figure 4:
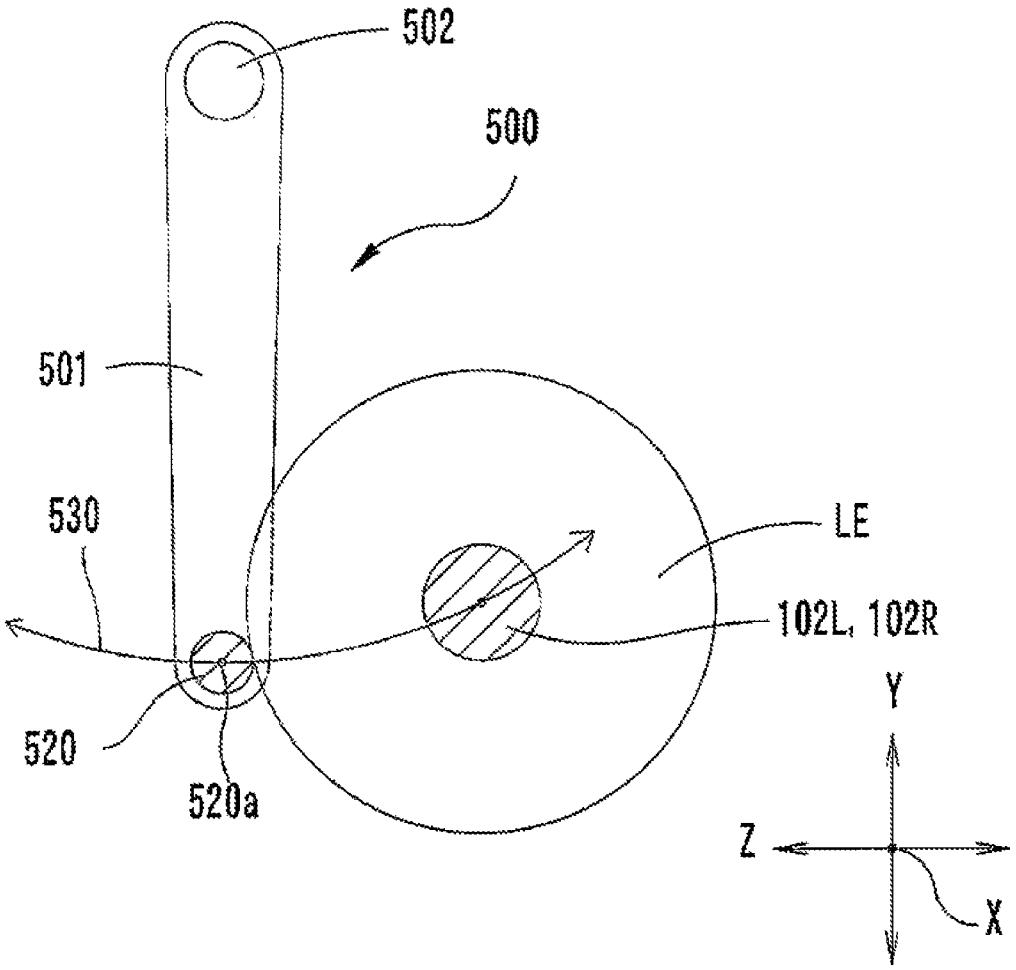

FIG. 4 is an explanatory view of measurement of lens external diameter by the lens external diameter detector.

Figure 5:
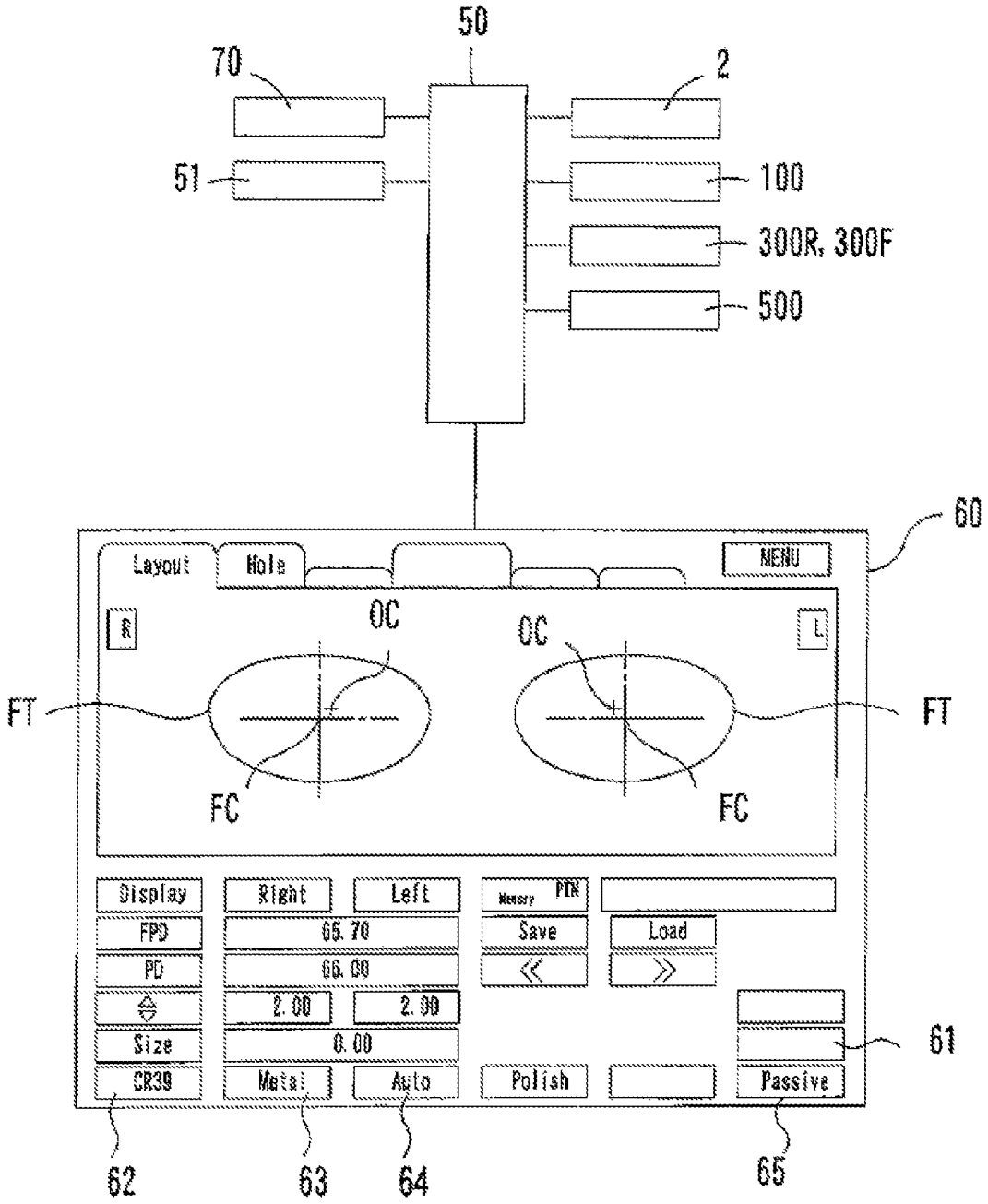

FIG. 5 is a control block diagram of the eyeglass lens processing apparatus.

Figure 6:
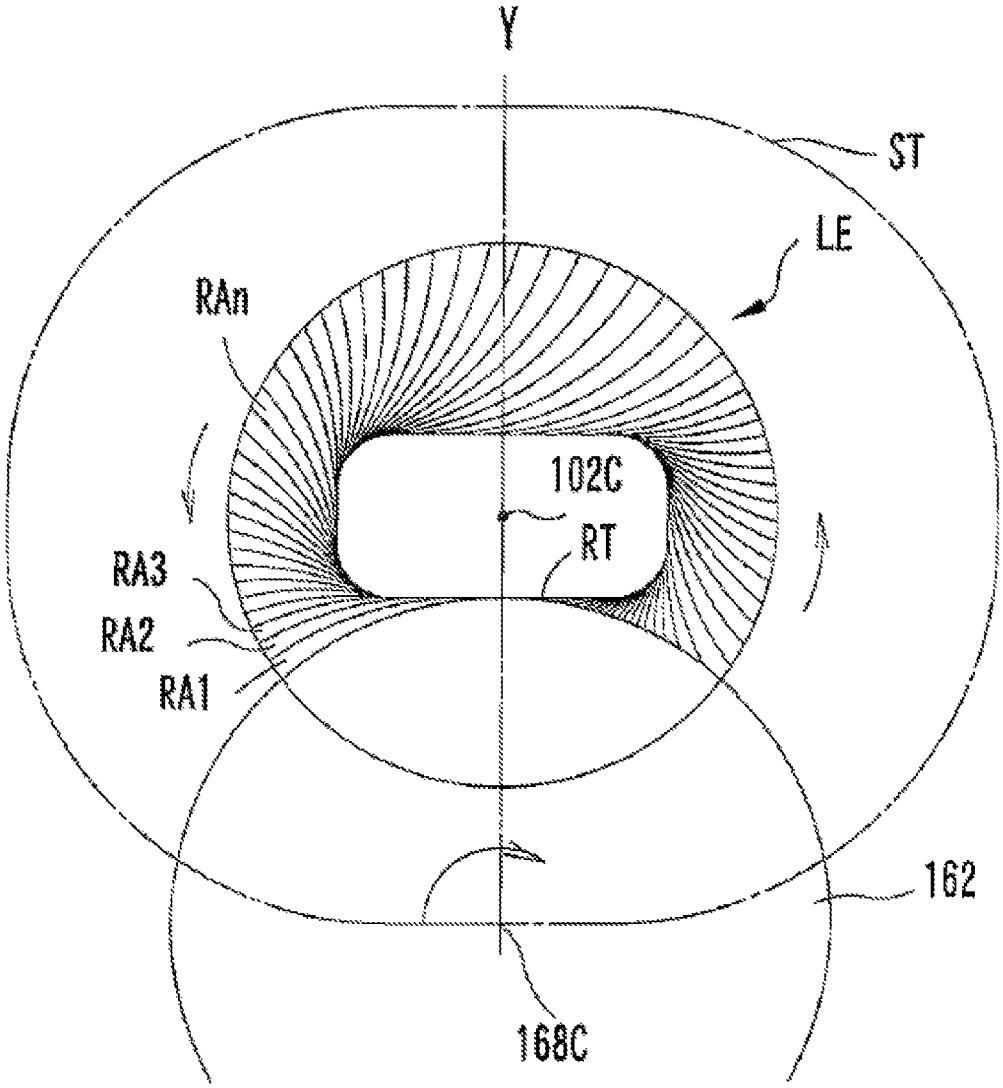

FIG. 6 is a schematic view illustrating a roughened lens.

Figure 7:
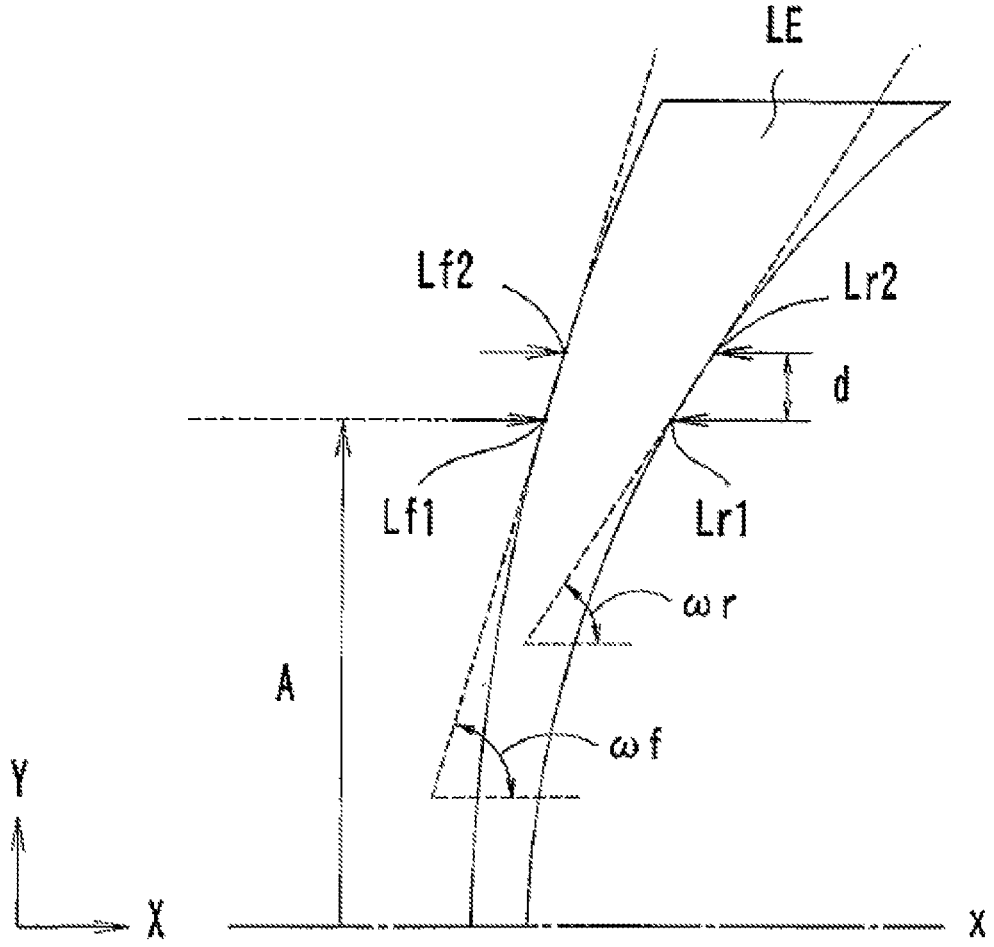

FIG. 7 is a view illustrating a method of obtaining the curve shape of the lens front surface and the curve shape of the lens rear surface.

Figure 8:
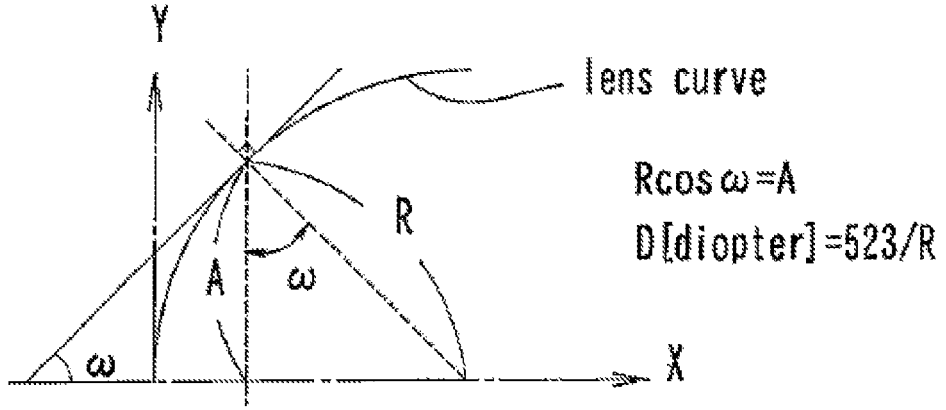

FIG. 8 is an explanatory view of the calculation of determining a curve D [diopter] based on the radius R of a curve and a tilt angle ω.

Figure 9:
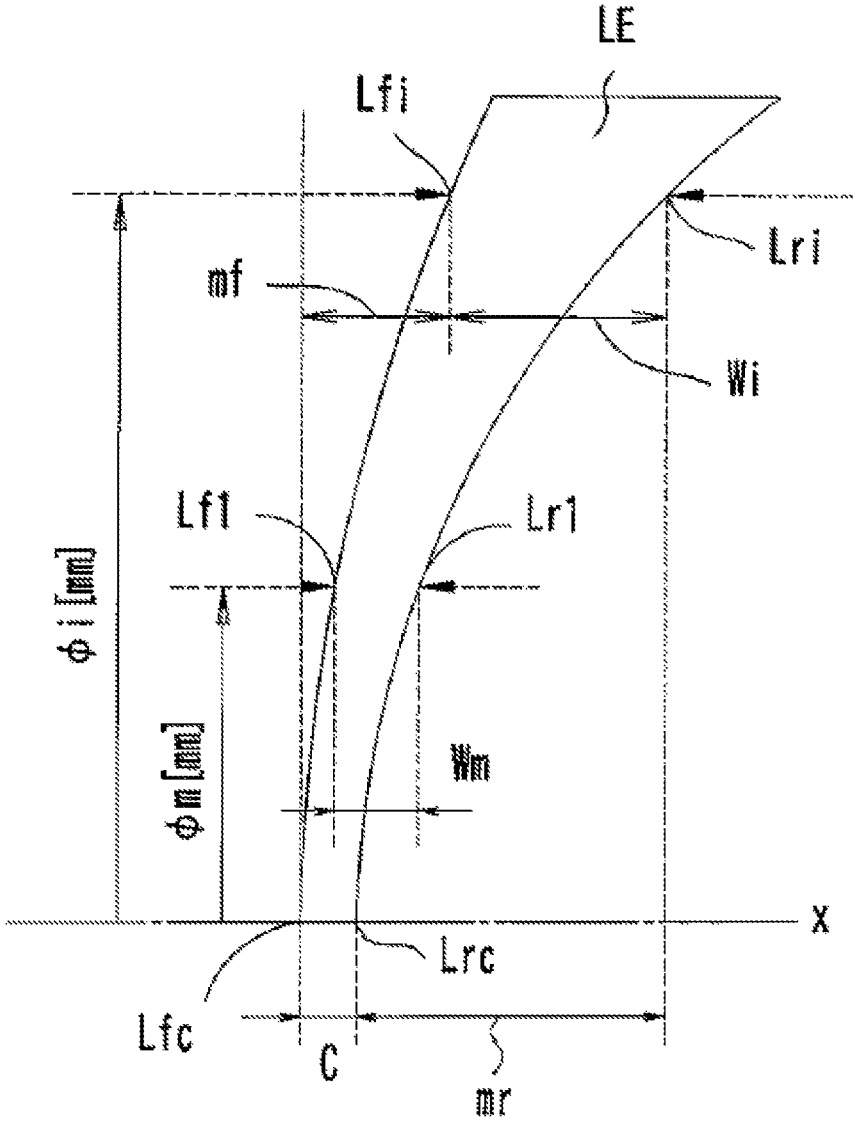

FIG. 9 is a view illustrating a method of estimating lens thickness based on the curve shape of the lens front surface and the curve shape of the lens rear surface.

Figure 10:
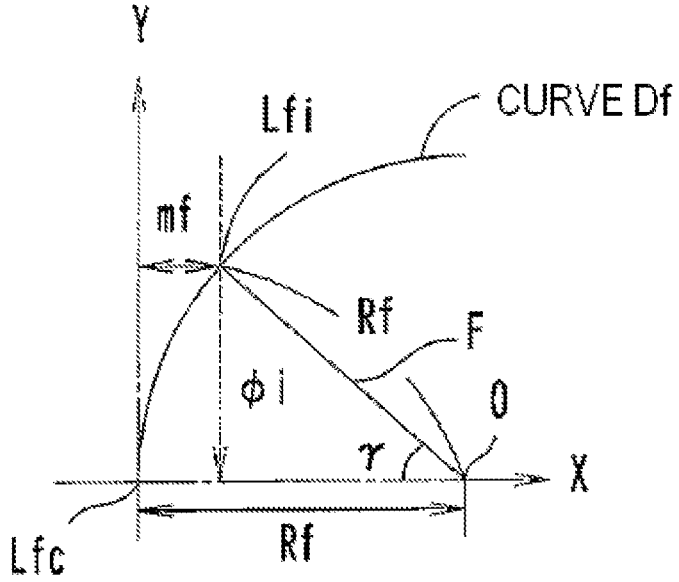

FIG. 10 is a view illustrating the concept of determining the distance mf of the lens front surface with respect to a lens front surface position on the X axis.

Figure 11:
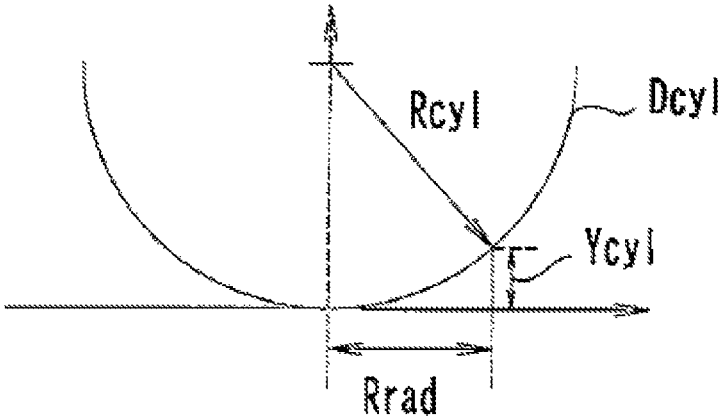

FIG. 11 is a view showing a curve Dcyl of the difference between astigmatism components on a strong principal meridian axis and a weak principal meridian axis in a case where a lens has the astigmatism components.

Figure 12:
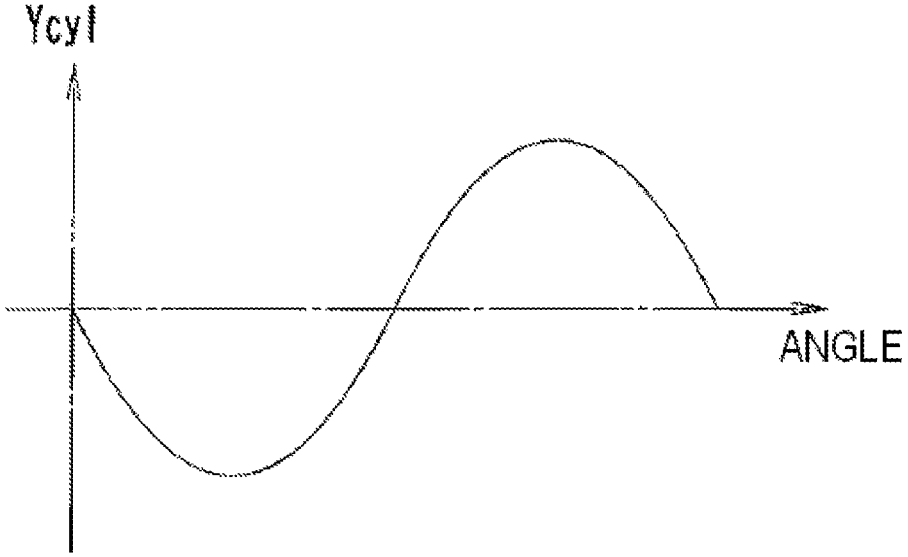

FIG. 12 is a view showing changes in the sinusoidal wave of the distance Ycyl.

Figure 13:
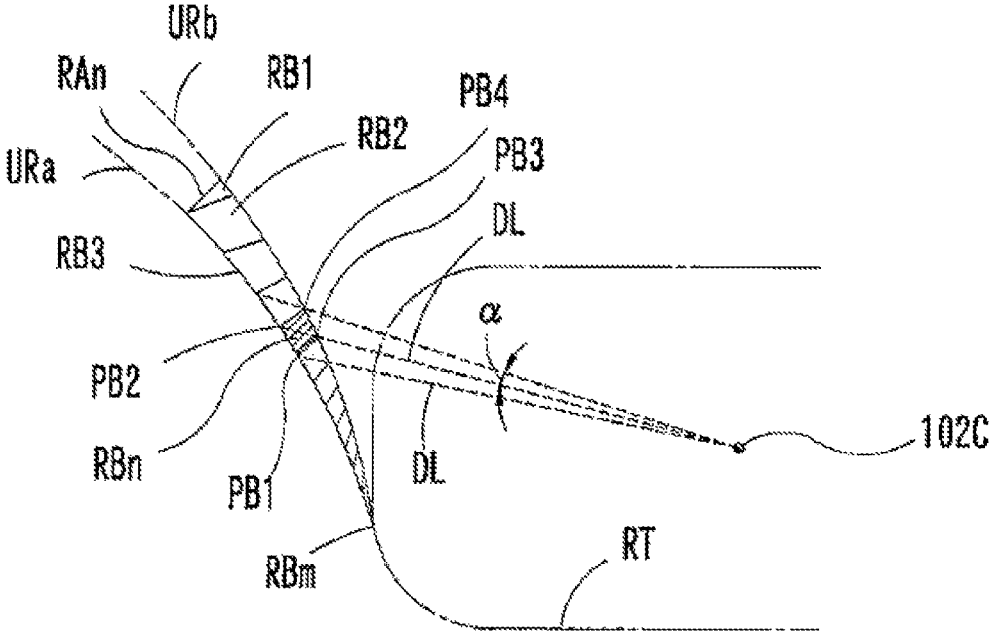

FIG. 13 is an enlarged view of a certain one processing region RAn in FIG. 6 and an explanatory view of a method that divides the processing region into small regions.

Figure 14:
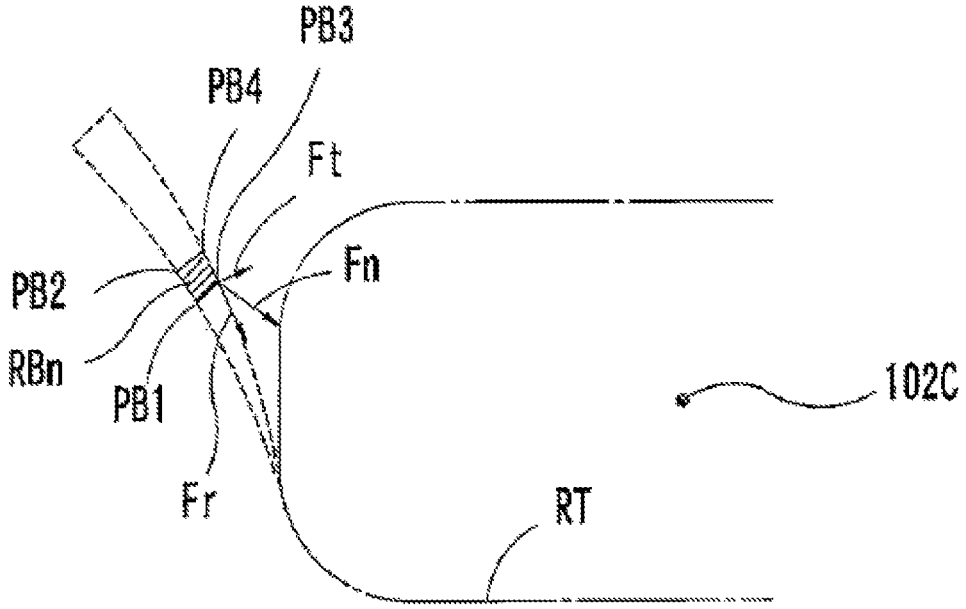

FIG. 14 is an explanatory view of the processing load when small regions are processed.

Figure 15:
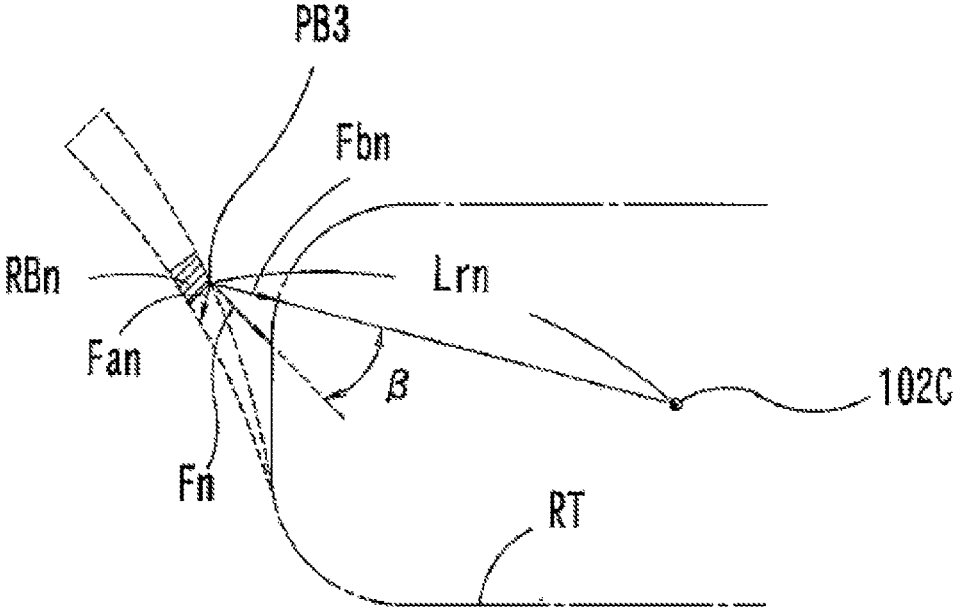

FIG. 15 is an explanatory view of the load torque applied to a lens chuck shaft when the small regions are processed.

Figure 16:
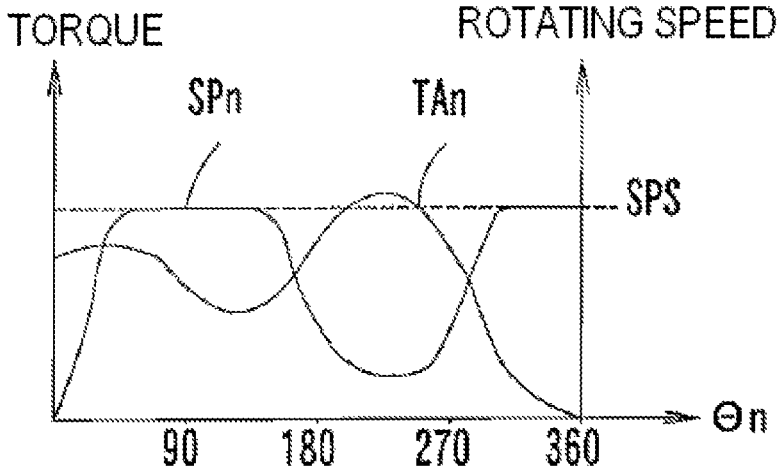

FIG. 16 is a graph showing an example of load torque at every rotation angle of the lens and the rotation speed of the lens.

DESCRIPTION OF EXEMPLARY EMBODIMENTS

Figure 1:
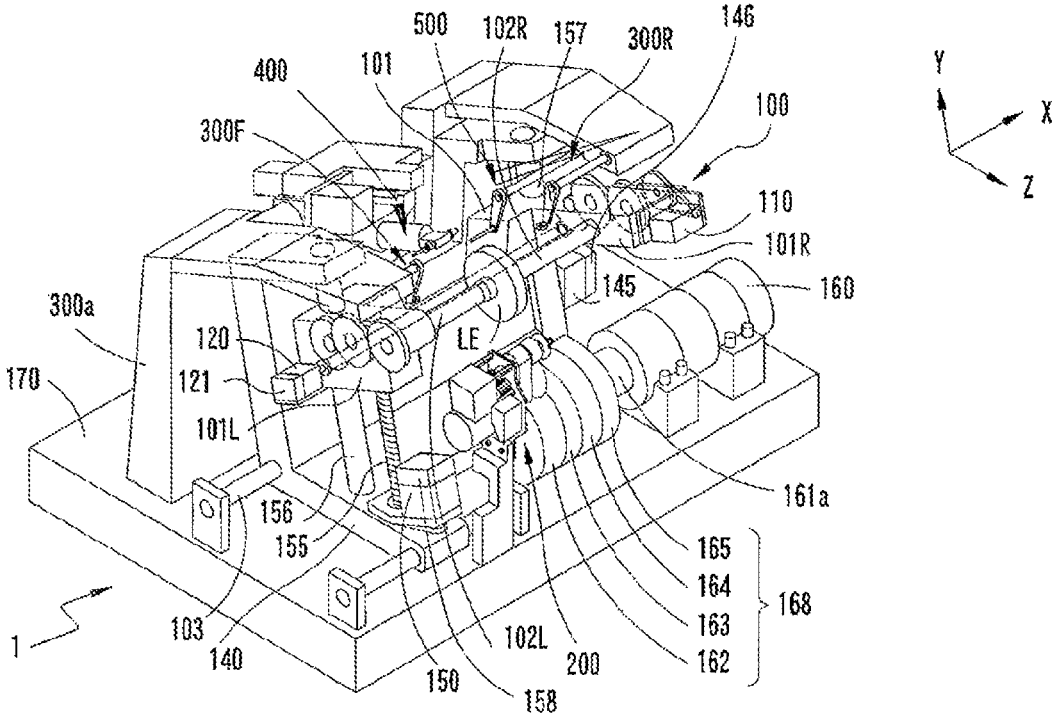
FIG. 1 is a schematic configuration view of a processing section of an eyeglass lens processing apparatus.

An exemplary embodiment of the invention will be described based on the drawings. FIG. 1 is a schematic configuration view of an eyeglass lens processing apparatus.

A carriage 101 that rotatably holds a pair of lens chuck shafts 102L and 102R is mounted on a base 170 of a processing apparatus 1. A peripheral edge of an eyeglass lens LE chucked by the chuck shafts 102L and 102R is brought into pressure contact with and processed by respective grindstones of a grindstone group 168 as a processing tool that is coaxially attached to a spindle (processing tool rotating shaft) 161*a*.

The grindstone group 168 includes a rough grindstone 162 for a plastic lens, a finishing grindstone 163 that has a front beveling surface for forming a front bevel of a high curve lens, and a rear beveling surface for forming a rear bevel, a finishing grindstone 164 that has a bevel-forming V groove and a flat-processing surface that are used for a low curve lens, and a polishing grindstone 165 that has a bevel-forming V groove and a flat-processing surface. The grindstone spindle 161*a* is rotated by a motor 160. These components constitute a grindstone rotary unit. A cutter may be used as a roughing tool and a finishing tool.

The lens chuck shaft 102R is moved to the lens chuck shaft 102L side by a motor 110 attached to a right arm 101R of the carriage 101. Additionally, the lens chuck shafts 102R and 102L are synchronously rotated via a rotation transmission mechanism, such as a gear, by a motor 120 attached to a left arm 101L. An encoder 121 that detects the rotation angles of the lens chuck shafts 102R and 102L is attached to a rotating shaft of the motor 120. In addition, the load torque applied to the lens chuck shafts 102R and 102L during processing can be detected by the encoder 121. These constitute a lens rotary unit.

The carriage 101 is mounted on a supporting base 140 that is movable along shafts 103 and 104 that extend in an X-axis direction, and is moved in the X-axis direction (axial direction of the chuck shafts) by the driving of a motor 145. An encoder 146 that detects the movement position of the carriage 101 (that is, the chuck shafts 102R and 102L) in the X-axis direction is attached to a rotating shaft of the motor 145. These constitute an X-axis direction movement unit for moving the lens chuck shafts 102R, 102L relative to the grindstone spindle 161*a*. Additionally, shafts 156 and 157, which extend in a Y-axis direction (a direction in which the axis-to-axis distance between the chuck shafts 102L and 102R and the grindstone spindle 161*a* is changed), are fixed to the supporting base 140. The carriage 101 is mounted on the supporting base 140 so as to be movable in the Y-axis direction along the shafts 156 and 157. A motor 150 for Y-axis movement is fixed to the supporting base 140. The rotation of the motor 150 is transmitted to a ball screw 155 that extends in the Y-axis direction, and the carriage 101 is moved in the Y-axis direction by the rotation of the ball screw 155. An encoder 158 that detects the movement positions of the chuck shafts in the Y-axis direction is attached to a rotating shaft of the motor 150. These constitute a Y-axis direction movement unit (axis-to-axis distance changing unit) for moving the lens chuck shafts 102R, 102L relative to the grindstone spindle 161*a*.

Figure 2:
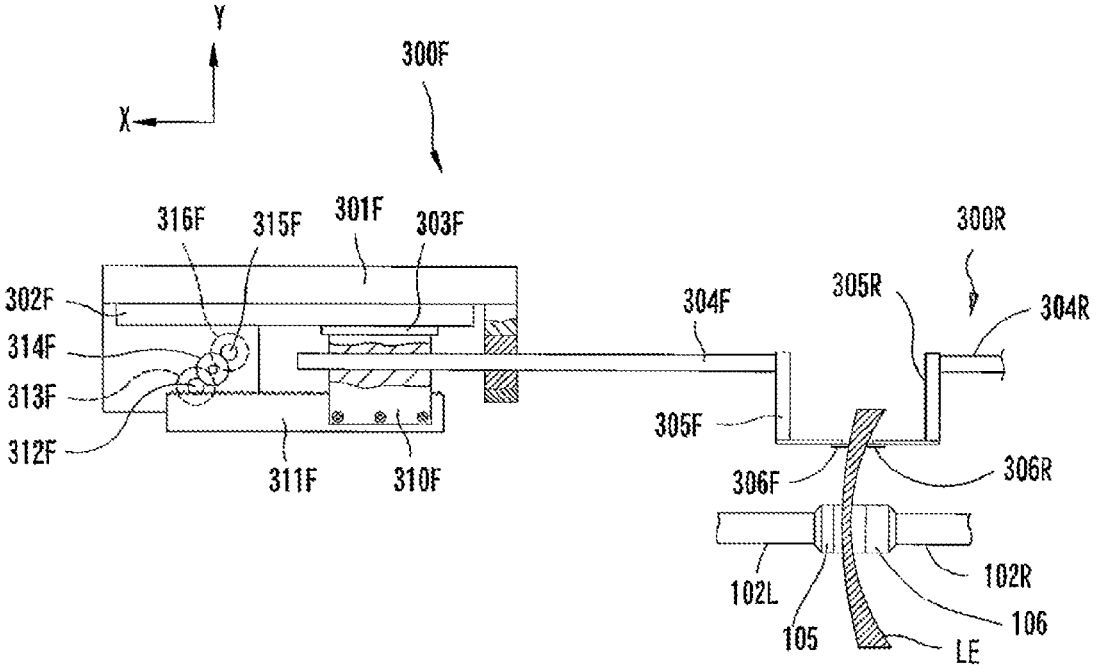
FIG. 2 is a configuration view of a lens edge position detector.

In FIG. 1, lens edge position detectors 300F and 300R as lens surface shape measurement units are provided on the upper left and right of the carriage 101. FIG. 2 is a schematic configuration view of the detector 300F that detects the edge position (an edge position on the side of the lens front surface on a target lens shape) of the lens front surface.

A supporting base 301F is fixed to a block 300*a* fixed on the base 170. A tracing stylus arm 304F is held by the supporting base 301F via a sliding base 310F so as to be slidable in the X-axis direction. An L-shaped hand 305F is fixed to a tip portion of the tracing stylus arm 304F, and a tracing stylus 306F is fixed to the tip of the hand 305F. The tracing stylus 306F is brought into contact with the front surface of the lens LE. A rack 311F is fixed to a lower end portion of the sliding base 310F. The rack 311F meshes with a pinion 312F of an encoder 313F fixed to the supporting base 301F side. Additionally, the rotation of a motor 316F is transmitted to the rack 311F via a rotation transmission mechanism, such as gears 315F and 314F, and the sliding base 310F is moved in the X-axis direction. The tracing stylus 306F put on a retracted position is moved to the lens LE side by the driving of the motor 316F, and the measurement pressure of pressing the tracing stylus 306F against the lens LE is applied. When the front surface position of the lens LE is detected, the lens chuck shafts 102L and 102R are moved in the Y-axis direction while the lens LE is rotated based on a target lens shape, and the edge position (the edge position on the side of the lens front surface on a target lens shape) of the lens front surface in the X-axis direction is detected by the encoder 313F.

Since the configuration of the edge position detector 300R of the lens rear surface is bilaterally symmetrical to the detector 300F, "F" at the ends of reference numerals given to the respective constituent elements of the detector 300F shown in FIG. 2 is replaced with "R", and the description thereof is omitted.

In FIG. 1, a chamfering unit 200 is arranged on the near side of an apparatus body, and a drilling and grooving unit 400 is arranged behind a carriage section 100. Since well-known configurations are used as the configurations of these, the details thereof are omitted.

Figure 3A:
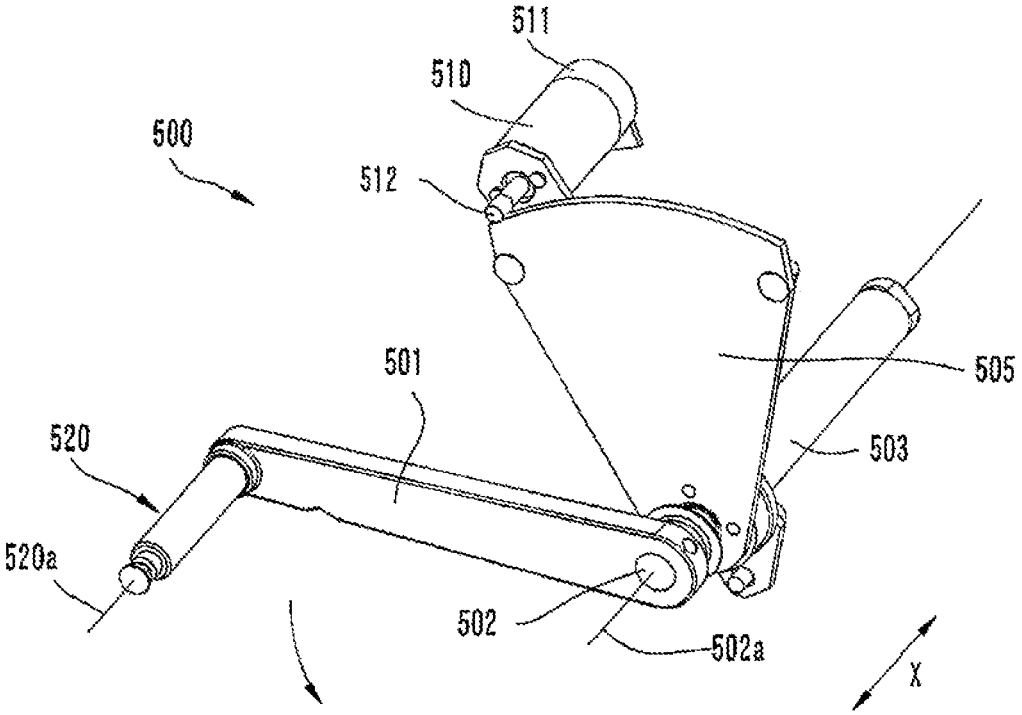
FIG. 3A is a schematic configuration view of a lens external diameter detector.
Figure 3B:
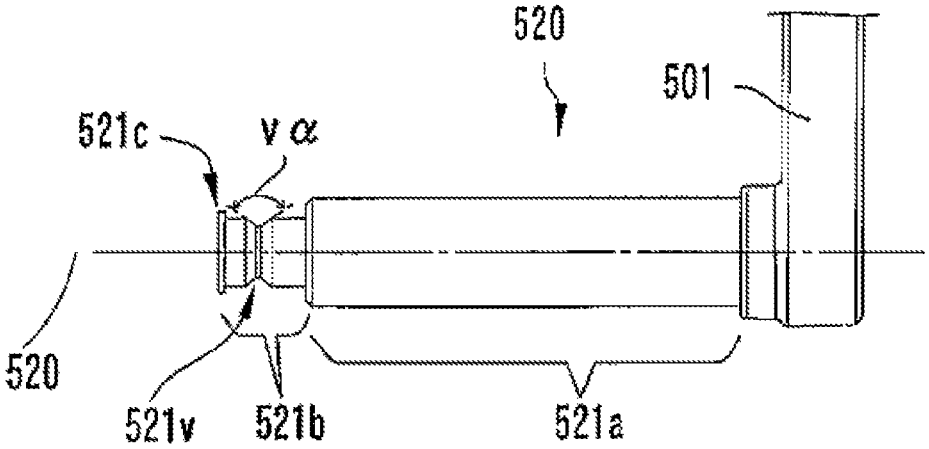

In FIG. 1, a lens external diameter detector 500 is arranged on the upper rear side of the lens chuck shaft 102R. FIG. 3A is a schematic configuration view of the lens external diameter detector 500. FIG. 3B is a front view of a tracing stylus 520 that the unit 500 has.

A columnar tracing stylus 520 that is brought into contact with the edge of the lens LE is fixed to one end of an arm 501, and a rotating shaft 502 is fixed to the other end of the arm 501. A central axis 520*a* of the tracing stylus 520 and a central axis 502*a* of the rotating shaft 502 are arranged in a positional relationship where the axes are parallel to the lens chuck shafts 102L and 102R (X-axis direction). The rotating shaft 502 is held by a holding portion 503 so as to be rotatable about the central axis 502*a*. The holding portion 503 is fixed to the block 300*a* of FIG. 1. Additionally, a fan-shaped gear 505 is fixed to the rotating shaft 502, and the gear 505 is rotated by a motor 510. A pinion gear 512 that gears with the gear 505 is attached to a rotating shaft of the motor 510. Additionally, an encoder 511 as a detector is attached to the rotating shaft of the motor 510.

The tracing stylus 520 has a columnar portion 521*a* that is contacted when the external diameter size of the lens LE is measured, a smaller-diameter columnar portion 521*b* including a V groove 521*v* to be used during the measurement of the X-axis direction position of a bevel formed in the lens LE, and a protruding portion 521*c* to be used during the measurement of the position of a groove formed in the lens. The opening angle Vα of the V Groove 521 is made equal to or greater than the opening angle of the bevel-forming V groove that the finishing grindstone 164 has. Additionally, the depth vd of the V groove 521*v* is made smaller than that of the V groove of the finishing grindstone 164. Thereby, the bevel formed in the lens LE by the V groove of the finishing grindstone 164 is inserted into the center of the V groove 521*v* without interfering with other portions.

The lens external diameter detector 500 is used in order to detect whether the external diameter of a non-processed lens LE is sufficient with respect to a target lens shape during the peripheral edge processing of a normal eyeglass lens LE. When the external diameter of the lens LE is measured, as shown in FIG. 4, the lens chuck shafts 102L and 102R are moved to a predetermined measurement position (on a movement path 530 of the central axis 520*a* of the tracing stylus 520 that rotates about the rotating shaft 502). As the arm 501 is rotated in a direction (Z-axis direction) orthogonal to the X axis and the Y-axis of the processing apparatus 1 by the motor 510, the tracing stylus 520 put on the retracted position is moved to the lens LE side, and the columnar portion 521*a* of the tracing stylus 520 is brought into contact with the edge (peripheral edge) of the lens LE. Additionally, a predetermined measurement pressure is applied to the tracing stylus 520 by the motor 510. As the lens LE is rotated at every predetermined minute angle step, and the movement of the tracing stylus 520 at this time is detected by the encoder 511, the external diameter size of the lens LE based on the chuck center is measured.

In addition, as the lens external diameter detector 500, a mechanism that is linearly moved in the direction (Z-axis direction) orthogonal to the X axis and the Y-axis of the processing apparatus 1 may be used in addition to being constituted by a rotating mechanism of the arm 501 as described above. Additionally, the lens edge position detector 300F (or 300R) as the lens surface shape measurement unit can be made to double as the lens external diameter detector. In this case, the lens chuck shafts 102L and 102R are moved in the Y-axis direction so that the tracing stylus 306F is moved to the lens external diameter side in a state where the tracing stylus 306F abuts against the lens front surface. Since the detection value of the encoder 313F changes steeply if the tracing stylus 306F reaches a lens external diameter, the lens external diameter can be detected based on the movement distance in the Y-axis direction at this time.

FIG. 5 is a control block diagram of the eyeglass lens processing apparatus. The control unit 50 performs calculation processing based on various measurement or input data while performing management or control of the overall apparatus. The respective motors, the lens edge position detectors 300F and 300R, and the lens external diameter detector 500, which are shown in FIG. 1, are connected to the control unit 50. Additionally, a display 60 that has a touch panel function for data input of processing conditions, a switch section 70 provided with a processing start switch, or the like, a memory 51, an eyeglass frame shape measurement device (illustration is omitted), or the like is connected to the control unit 50. A lens processing program (processing sequence), a program that determines (estimates) a lens thickness based on the edge positions of the lens front and rear surfaces and the lens external diameter, and a program that determines the rotating speed (control data) of the lens chuck shaft 102R during roughing, or the like is stored in the memory 51. Additionally, in the memory 51, the external diameter of the lens measured by the lens external diameter detector 500 is stored, and the data of the lens front and rear surfaces measured by the edge position detectors 300R and 300F is stored.

Next, the operation of the present apparatus will be described. The target lens shape data (rn, θn) (n=1, 2, 3 . . . , and N) of the lens frames obtained by the measurement of the eyeglass frame shape measurement section 2 is input by pushing switches of the switch section 70, and is stored in the memory 51. Target lens shape figures FT based on the input target lens shape data are displayed on the display 60. Layout data, such as the distance (PD value) between a wearer's pupils, the distance (FPD value) between frame centers of eyeglass frames F, and the height of an optical center OC with respect to a geometric center FC of the target lens shape, is allowed to be input. The layout data can be input by operating predetermined touch keys. If the layout data is input, the input target lens shape data is converted into the new target lens shape data (rn, θn) (n=1, 2 and 3, . . . , and N) based on the geometric centers FC by the control unit 50. rn is the radial vector length of the target lens shape, and θn is the radius vector angle of the target lens shape. N is 1000 points, for example.

Additionally, processing conditions, such as the material of lenses, the type of frames, processing modes (beveling mode, flat-processing mode), and the presence or absence of chamfering, can be set by the touch keys 62, 63, and 64. As the material of lenses, normal plastic lenses, high-refraction plastic lenses, polycarbonate lenses, or the like can be selected by the key 62.

Additionally, prior to the processing of the lens LE, an operator fixes a cup Cu that is a fixture to the lens front surface of the lens LE, using a well-known collimating machine. At this time, there is an optical center mode where the cup is fixed to the optical center OC of the lens LE, and a frame center mode where the cup is fixed to the geometric center FC of the target lens shape. The optical center mode or the frame center mode can be selected by the touch key 65. In the optical center mode, the optical center OC of the lens LE is chucked by the lens chuck shafts (102L, 102R), and becomes the rotation center of the lens. In the frame center mode, the geometric center FC of the target lens shape is chucked by the lens chuck shafts, and becomes the rotation center of the lens.

Additionally, in a lens (water-repellant lens) subjected to water-repellant coating and having a slippery surface, "axis deviation" is apt to occur during roughing. The "axis deviation" means a phenomenon in which the attachment position between the lens and the cup Cu slips, and the axial angle of the lens deviates with respect to the rotation angle of the lens chuck shaft. A soft processing mode (water-repellant lens processing mode: first mode) to be used during the processing of the slippery lens, and a normal processing mode (second mode) to be used during the processing of a normal plastic lens that is not subjected to the water-repellant coating can be selected by the touch key (switch) 61. A case where the soft processing mode is selected will be described below.

The operator inserts the cup Cu fixed to the lens LE into a cup holder provided on the tip side of the lens chuck shaft 102L. Then, as the lens chuck shaft 102R is moved to the lens LE side by the driving of the motor 110, the lens LE is held by the lens chuck shaft 102R. If a start switch of the switch 7 is pushed after the lens LE is held by the lens chuck shaft 102R, the lens edge position detectors 300F and 300R, and the lens external diameter detector 500 is operated by the control unit 50, and the curve shape of the lens front and rear surfaces and the lens external diameter are measured. The measured lens external diameter is stored in the memory 51.

In addition, in an apparatus that is not equipped with the lens external diameter detector 500 when the lens external diameter data is acquired, a configuration in which the data of the lens external diameter measured by a vernier caliper or the like is input by a switch provided on the display 60 may be adopted. Additionally, even when the curve shape of the lens front and rear surfaces is acquired, a configuration in which the data of the curve shape of the lens front and rear surfaces that is independently measured is input by a switch provided on the display 60 may be adopted. The input lens external diameter data and the input curve shape data of the lens front and rear surfaces are stored in the memory 51.

After the measurement of the curve shape of the lens front and rear surfaces and the measurement of the lens external diameter are completed, the processing is shifted to a roughing process. The roughing operation of suppressing the "axis deviation" will be described below. FIG. 6 is a schematic view illustrating the roughing operation. In addition, in the following in order to simplify the description, the chuck center (rotation center) 102C of the lens shall be the optical center OC of the lens. Additionally, when a plastic lens is selected, a down-cut method in which the rotational direction of the lens LE is reversed to the rotational direction of a grindstone 168 is performed. FIG. 6 is a view when the lens LE is viewed from the lens rear surface. Here, the rough grindstone 162 is rotated clockwise and the lens LE is rotated counterclockwise.

The control unit 50 calculates a roughing path RT processed by the rough grindstone 162 based on the input target lens shape data. The roughing path RT is calculated by adding a finishing margin (for example, 2 mm) to the target lens shape. As a first stage during roughing, the control unit 50 first moves the lens chuck shafts 102L and 102R without rotating the lens LE, and performs cutting until the rough grindstone 162 reaches the roughing path RT (also including the case of the vicinity of the roughing path RT). A state where the rough grindstone 162 has reached the roughing path RT is shown in FIG. 6. Thereafter, as a second stage during the roughing, the control unit 50 controls the movement (motor 150) of the lens chuck shafts 102L and 102R so that the rough grindstone 162 moves along the roughing path RT while rotating the lens LE, and performs roughing of the peripheral edge of the lens LE. In FIG. 6, RA1, RA2, RA3, . . . represents processing regions when the lens LE is rotated at every predetermined unit angle Δθ (hereinafter, a processing region when being rotated a certain unit angle is defined as RAn). In practice, although a rotation center 168C of the rough grindstone 162 is fixed and the lens LE is processed while being rotated, FIG. 6 shows that the rough grindstone 162 moves relatively along the roughing path RT. The movement path of the rotation center 168C of the rough grindstone 162 at this time is shown as ST.

As for the load torque applied to the lens chuck shafts 102L and 102R when the lens LE is roughed while being rotated at every rotation angle θn (n=1, 2 and 3, . . . , and N) after the rough grindstone 162 performs cutting up to the roughing path RT without rotating the lens LE, the calculation in which the load torque is set to be equal to or lower than a reference where the "axis deviation" does not occur will be described below. In addition, in the following in order to simplify the description, the chuck center (rotation center) 102C of the lens shall be the optical center OC of the lens LE.

In FIG. 6, the processing amount of the processing region RAn where the lens LE is roughed at every rotation angle θn (n=1, 2, 3, . . . , and N) rotated at a unit rotation angle Δθ is determined based on condition data including the roughing path RT, the curve shape of the lens front and rear surfaces, the lens external diameter, the diameter of the rough grindstone 162, and the rotational direction of the rough grindstone 162. The diameter of the rough grindstone 162 is stored in the memory 51. Lens thickness at a radial position of the lens around a chuck center of the lens chuck shafts 102R, 102L is obtained based on the curve shape of the lens front and rear surfaces. The processing load Fn when the processing region RAn is roughed is proportional to the magnitude of the processing amount of the processing region RAn. The load torque TA applied to the lens chuck shafts 102L and 102R when the processing region RAn is processed is obtained by the processing load Fn generated by the rotation of the rough grindstone 162 and the direction of the processing load Fn, and the distance from the chuck center 102C to the processing region RAn. The direction of the processing load Fn is determined by the rotational direction of the rough grindstone 162.

Here, a method of determining the curve shape of the lens front and rear surfaces and the lens thickness will be described prior to the description of a calculation method of the load torque TA. FIG. 7 is a view illustrating a method of obtaining the curve shape of the lens front and rear surfaces. When the shape of the lens front and rear surfaces is measured, the edge positions of the lens front and rear surfaces are measured by the lens edge position detectors 300F and 300R with two measurement paths according to the target lens shape data (rn, θn) (n=1, 2, 3, . . . , and N). N that is the number of measurement points is 1000 points, for example. Accordingly, the interval between the points becomes 0.36 degrees. The first measurement path is the path of the radius vector length (rn) of the target lens shape data. The second measurement path is an outside path from the radius vector length (rn) of the target lens shape data by a fixed distance d (for example, 1 mm). In addition, in FIG. 7, the radial vector length (rn) is written as A. The tracing styluses 306F and 306R abut against positions Lf1 and Lr1 in FIG. 7, respectively, and the positions, in the X-axis direction, of the lens front and rear surfaces of the first measurement path are measured. Next, the tracing stylus 306F and the tracing stylus 306R abut against positions Lf2 and Lr2 in FIG. 7, respectively, and the edge positions, in the X-axis direction, of the lens front and second surfaces of the second measurement path are measured.

The tilt angle ωf of the lens front surface is obtained at every lens rotation angle (radius vector angle) θn by a straight line that connects the position Lf1 and the position Lf2. The tilt angle ωr of the lens rear surface is obtained at every lens rotation angle (radius vector angle) θn by a straight line that connects the position Lr1 and the position Lr2.

Next, a lens front surface curve Df and a lens rear surface curve Dr are approximately obtained in the following formulas, respectively, by the tilt angle ωf of the lens front surface and the tilt angle ωr of the lens rear surface.

$$Df[diopter] = \frac{523 \cdot \cos\omega f}{A} \qquad \text{Formula 1}$$

$$Dr[diopter] = \frac{523 \cdot \cos\omega r}{A}$$

In the above Formula 1, Df [diopter] showing the lens front surface curve and Dr [diopter] showing the lens rear surface curve are written as values obtained by dividing the numerical value 523 by the radius R (mm) of the curve conventionally. The calculation of determining the curve D [diopter] from the radius R of the curve and the tilt angle ω is supplementarily shown in FIG. 8.

Next, a method of estimating lens thickness based on the curve shape of the front surface of the lens and the curve shape of the rear surface of the lens will be described with reference to FIG. 9. In addition, FIG. 9 shows a case where a lens without any astigmatism component (both the lens front surface and the lens rear surface are the spherical surfaces) is assumed. In FIG. 9, the lens thickness at the distance (processing distance) ϕi [mm] from a processing center to an arbitrary point is defined as Wi [mm] Additionally, the distance to a lens front surface position Lfi at a distance ϕi [mm] from a lens front surface position Lfc on the X axis (a center of lens chucking axis) is defined as mf. Similarly, the distance to a lens rear surface position Lri at a distance ϕi [mm] from a lens rear surface position Lrc on the X axis is defined as mr. The distance from the position Lfc to the position Lrc on the X axis is defined as C. At this time, the lens thickness Wi at the distance ϕi is obtained in the following formula.

$$Wi(\phi i) = mr + C - mf \qquad \text{Formula 2}$$

Here, the distances mf and mr are obtained in the following formulas, respectively.

$$mf = \frac{523}{Df}\left\{1 - \cos\left[\sin^{-1}\left(\frac{\varphi i \cdot Df}{523}\right)\right]\right\} \qquad \text{Formula 3}$$

$$mf = \frac{523}{Dr}\left\{1 - \cos\left[\sin^{-1}\left(\frac{\varphi i \cdot Dr}{523}\right)\right]\right\}$$

In addition, mf of Formula 3 is derived based on the following formula. In FIG. 10, if the angle formed between a line segment F connecting the center O of the curve Df of the lens front surface and the position Lfi and the X axis is defined as γ and the radius of the curve Df is defined as Rf, there are the following relationships.

$$mf = Rf(1 - \cos\gamma) \qquad \text{Formula 4}$$

$$Rf \cdot Df = 523$$

$$\gamma = \sin^{-1}\frac{\varphi i}{Rf}$$

In the above Formula 4, a solution about mf becomes a formula that determines mf of Formula 3. A formula that determines mr of Formula 3 is derived by the similar concept.

Additionally, in FIG. 9, if the distance from the lens front surface position Lf1 to the lens rear surface position Lf1 that is actually measured using the radius vector length ϕm of the target lens shape is defined as Wm, the distance C (the lens thickness on X axis) is obtained in the following formula by applying FIG. 10 and the concept of the above Formula 4.

$$C = Wm - \frac{523}{Dr}\left\{1 - \cos\left[\sin^{-1}\left(\frac{\varphi m \cdot Dr}{523}\right)\right]\right\} + \frac{523}{Df}\left\{1 - \cos\left[\sin^{-1}\left(\frac{\varphi m \cdot Df}{523}\right)\right]\right\} \quad \text{Formula 5}$$

In a case where the lens LE has no astigmatism component (in the case of a spherical lens), the values of respective Df and Dr obtained at every lens rotation angle (radius vector angle) θn are averaged by the number N of measurement points, and the averaged value is substituted in Formula 3 and Formula 4. Thereby, the lens thickness Wi at an arbitrary distance ϕi is obtained.

Although FIG. 9 shows a case where it is assumed that the lens LE has no astigmatism component (CYL), since an actual lens has astigmatism components, a lens thickness in which astigmatism components are reflected as described below is estimated.

The radius vector length rn of the target lens shape data is substituted in the distance ϕi of Formula 3, and the lens thickness Wi at every radius vector angle of the whole circumference is obtained by Formula 2. Wi that is this calculation result becomes the lens thickness at the radial vector length rn of the target lens shape data when it is assumed that the lens is a spherical lens. The difference ΔWm between this calculation result, and the lens thickness Wm at every radius vector angle of the whole circumference obtained by measurement results of actual lens edge position measurement is calculated. Then, the sinusoidal wave of the difference ΔWm at every radius vector angle is obtained, a point where the maximum value of the sinusoidal wave is present becomes a strong principal meridian axis of the astigmatism components, and a point where the minimum value of the sinusoidal wave is present becomes a weak principal meridian axis.

Next, based on the position Lr1 measured on the first measurement path in the radius vector angle of the strong principal meridian axis and the position Lr2 measured on the second measurement path, the lens curve Dcyl [diopter] of the difference between the strong principal meridian axis and the weak principal meridian axis is obtained by the same concept as Formula 1. As shown in FIG. 11, the lens thickness is estimated based on the lens curve Dcyl of the strong principal meridian axis. FIG. 11 is a view showing the curve Dcyl of the difference between the strong principal meridian axis and the weak principal meridian axis. In FIG. 11, Rrad is a distance that is equivalent to the distance ϕi [mm] on the curve Dcyl. If the distance to the curve Dcyl at Rrad is defined as Ycyl, Ycyl is obtained in the following formula.

$$Ycyl = Rcyl - \sqrt{Rcyl^2 - Rrad^2} \quad \text{Formula 6}$$

$$Rcyl = \frac{523}{Dcyl}$$

Rcyl at every Rrad (ϕi) obtained in the above formula is added to the lens thickness Wi obtained in Formula 2, and this is used as a new lens thickness Wi. Since this is the calculation of the lens thickness on the strong principal meridian axis, the lens thickness Wi on the whole circumference is obtained by determining the curve Dcy at every unit rotation angle between the weak principal meridian axis and the strong principal meridian axis and performing the same calculation as the above formulas. For example, changes in the sinusoidal wave of the distance Ycyl as shown in FIG. 12 are obtained by calculating the difference ΔWm at every radius vector angle (every lens rotation angle) on the same radius. This sinusoidal wave has values showing a toric surface curve of an astigmatism lens with respect to a spherical lens curve. Accordingly, the lens thickness Wi of the astigmatism lens is obtained over the whole circumference by obtaining the distance Ycyl at every radius vector angle (lens rotation angle) depending on changes in this sinusoidal wave, and adding this distance to the lens thickness Wi in a case where it is assumed that the lens is a spherical surface.

In addition, in the calculation of the processing volume (the processing amount) to be described below, it is preferable to assume an astigmatism lens in which the lens rear surface becomes a toric surface in respect to precision. However, it is not necessary to assume the astigmatism lens.

Next, as for the processing region RAn when the lens LE is rotated at every unit angle, a calculation method of estimating the processing load of the processing region and the load torque applied to the lens chuck shafts will be described. FIG. 13 is an enlarged view of one certain processing region RAn in FIG. 6. In order to calculate the load torque TA when the processing region RAn is processed, the processing region RAn is further divided into small regions by a predetermined calculation method. In FIG. 13, the processing region RAn is divided into m pieces, and the divided small regions are defined as RB1, RB2, RB3, . . . , and RBm. An example of the division method will be described. For example, a division straight line DL, which is divided at an angle α of an integral multiple of the unit angle Δθ about the chuck center 102C and extends radially, is set. The angle α is set to 1.8 degrees that is 1/200 of the total number (1000 points) of points of the radius vector angle. The points of intersection with a path URa of a grindstone surface before lens rotation when the processing region RAn is obtained and with a path URb of the grindstone surface after the lens LE is rotated by the unit rotation angle Δθ are obtained, respectively. As for one small region RBn among the small regions RB1 to RBm, the points of intersection of two division straight lines DL with a path URa before lens rotation are defined as PB1 and PB2. Additionally, the points of intersection of the two division straight lines DL with a path URb after lens rotation when the straight lines are rotated by an angle α are defined as PB3 and PB4. By determining coordinate positions of the points PB1, PB2, PB3, and PB4, the area SBn (the area when the small region RBn is viewed from the direction of the lens chuck shafts) of the small region RBn is obtained. The coordinate positions of the point PB1, PB2, PB3, and PB4 are mathematically obtained based on the relationship among the diameter of the rough grindstone 162, the roughing path RT, the rotation angle of the lens LE when the processing region RAn is obtained, and the angular orientation of the two straight lines DL. The volume (processing amount) VBn of the small region RBn is obtained by the lens thickness and area SBn of the small region RBn. Respective lens thicknesses in the points PB1, PB2, P3, and PB4 are obtained by the aforementioned method described in FIGS. 7 to 12. The average of the lens thicknesses of the four points may be approximately the lens thickness of the small region RBn. The volumes VB1, VB2, VB3, . . . , and VBm of the small regions RB1 to RBm are calculated by the same method.

Next, a calculation method of the processing load and load torque when the small region RBn of the volume VBn is processed will be described. In FIG. 14, when the small region RBn is cut by the rough grindstone 162, a frictional force Fr applied to the tangential direction of a contact surface of the rough grindstone 162 is generated, and a reaction force Ft is generated in a direction perpendicular to the frictional force Fr. The direction of the frictional force Fr is related to the rotational direction of the rough grindstone 162. A vector Fn obtained by synthesizing the vector of the frictional force Fr and the vector of the reaction force Ft becomes the processing load Fn when the small region RBn is processed. The direction of the processing load Fn is also obtained by the direction of the frictional force Fr and the direction of the reaction force Ft. The reaction force Ft may be calculated as a constant. The processing load when unit volume is processed is constant, and the processing load Fn is proportional to the volume of the small region RBn. If the processing load per unit volume is defined as Fo, the processing load Fn is obtained by the product of the processing load Fo and the volume VBn of the small region RBn. The processing load Fo is experimentally obtained.

In addition, in the down-cut method, the reaction force Ft is canceled to some extent by the frictional force Fr, and is relatively very small with respect to the frictional force Fr. For this reason, in actual calculation, there is no problem even if the reaction force Ft is approximately neglected.

When the load torque in the rotational direction applied to the lens chuck shafts 102L and 102R is considered, the load torque is obtained by the product of the distance from a point (referred to as a force point) where a force is applied during roughing to the chuck center 102C, and a force (force applied to the force point) applied in a direction perpendicular to a line segment that connects the force point and the chuck center 102C. The force point when the small region RBn is processed is typically considered as a center-of-gravity position of the small region RBn, in practical calculation, one of the points PB1, PB2, PB3, and PB4 used for the calculation of the volume of the small region RBn can be approximately used. For example, the point PB3 in FIGS. 13 and 14 is used as a force point.

FIG. 15 is an explanatory view of the load torque TBn applied to the lens chuck shafts 102L and 102R when the small region RBn is processed. In FIG. 15, the distance of a line LB that connects the chuck center 102C and the point PB1 is defined as Lrn. When the load torque TBn is considered, the processing load Fn is discomposed into a processing load Fan in a direction orthogonal to a line LB at a point PB3, and a processing load Fbn in a direction along the line LB. The direction of the line LB is obtained based on the position coordinate of the point PB3 based on the chuck center 102C, and the direction of the processing load Fn is obtained based on the direction of the frictional force Fr of FIG. 14 and the direction of the reaction force Ft. In a case where the reaction force Ft is neglected, the direction of the processing load Fn is the tangential direction of a curve (grindstone surface) of the rough grindstone 162 passing along the point PB3. If the direction of the processing load Fn with respect to the direction of the line LB is defined as an angle β, the processing load Fan is obtained in the following formula.

$$\text{Fan}=Fn\times\sin\beta \qquad \text{[Formula 7]}$$

Additionally, when the small region RBn is processed, the load torque TBn applied to the lens chuck shafts 102L and 102R is obtained in the following formula.

$$TBn=Lrn\times\text{Fan} \qquad \text{[Formula 8]}$$

The load torques TB1, TB2, TB3, . . . , and TBm for the small regions RB1, RB2, . . . , and RBm are obtained by performing the calculation of the load torque TBn described above for the small regions RB1, RB2, RB3, . . . , and RBm shown in FIG. 13, respectively. The load torque TA in the lens rotational direction applied to the lens chuck shafts when the overall processing region RAn is roughed is obtained by integrating the load torques TB1 to TBm.

In addition, in the calculation of the load torque TA, it is preferable to determine the load torques for the divided small regions RB1 to RBm. However, there are approximately various methods. For example, the overall processing region RAn is considered, the center-of-gravity point of the processing region RAn is used as a force point when the load torque TA is calculated, and the processing load Fn applied to the center-of-gravity point is obtained based on the volume of the processing region RAn. The direction of the processing load Fn applied to the center-of-gravity point can be the tangential direction of the curve of the grindstone surface where the rough grindstone 162 is located when the center-of-gravity point is processed. Thereby, the load torque TA when the processing region RAn is processed is approximately obtained by the same method as the aforementioned concept of the load torque.

The load torque TAn (n=1, 2, 3, . . . , and N) (N is a number obtained dividing the whole circumference by the unit rotation angle Δθ) at every rotation angle of the lens LE is obtained by performing the calculated of the load torque TA described above for the processing regions RA1, RA2, RA3, . . . shown in FIG. 6.

Next, a control method of the rotating speed of the lens (that is, lens chuck shafts) based on the load torque TAn at every rotation angle of the lens LE will be described. In order to keep the "axis deviation" from occurring during roughing, the lens is rotated at a rotating speed where the load torque per unit time during lens rotation becomes equal to or lower than a predetermined reference value TS. The load torque T per unit time is obtained by a value (total of the load torque TAn) obtained by sequentially adding the load torque TAn obtained at every rotation angle of the lens. The rotating speed of the lens is preferably obtained so that the load torque T per unit time is as close to the reference value TS as possible.

FIG. 16 shows an example in which the load torque TAn at every rotation angle θn (n=1, 2, 3, . . . , and N) of the lens is represented as a graph, and simultaneously an example in which the rotating speed SPn of the rotation angle θn is represented as a graph. The rotating speed SPn is made fast at the angle θn where the load torque TAn is small, and the rotating speed SPn is made slow at the angle θn where the load torque TAn is large. In addition, since the remaining processing volume decreases in the second half of the lens rotation, the rotating speed SPn becomes fast in terms of calculation. However, if the rotating speed SPn is too fast when the remaining processing volume has decreased, the lens LE may be damaged. For this reason, the rotating speed SPn is obtained as control data that does not exceed an upper speed limit SPS set so that damage of the lens LE does not occur at least in the second half in one rotation of the lens. Since there is almost no possibility of damage of the lens LE in the first half of the lens rotation, an upper speed limit, which is set so that the rotation of the lens is appropriately performed separately from the upper speed limit SPS for suppressing damage, may be applied.

In the second stage of the roughing, based on the control data of the lens rotating speed obtained as described above, the control unit 50 controls the driving of the motor 120 of the lens rotary unit to control the driving of the motor 150 of the Y-axis direction movement unit while rotating the lens LE to move the lens LE in the Y-axis direction so that the surface of the rough grindstone 162 runs along the roughing path RT. Thereby, the roughing of the peripheral edge of the lens LE is efficiently performed while suppressing the "axis deviation". Although the roughing is fundamentally ended at one rotation of the lens LE, the rotation of the lens LE may be further added to perform roughing in a case where the amount that is cut in the stage where the lens LE is not rotated is slightly larger than the roughing path RT or in a case where there is an uncut part. In this case, since most of the roughing of the lens LE is completed, occurrence of the "axis deviation" is reduced in the additional rotation of the lens. Even in this case, the rotation of the lens LE is preferably controlled after the load torque TAn at every rotation angle of the lens LE as described above is obtained.

After the roughing is completed, the peripheral edge of the lens LE is finished by the finishing grindstone 164 based on the finishing data calculated based on the target lens shape. Although the finishing includes beveling, flat-processing, or the like, since well-known methods are applied to the control of this finishing, the description thereof is omitted.

The above is the control of a soft mode processing mode (first mode) to be used for the water-repellant lens. In a normal processing mode (second mode), the reference value TS of the load torque is applied when the rotating speed of the lens LE is obtained, is set larger. For example, the reference value TS of the normal processing mode is set to be 1.5 to 2 times the reference value of the soft mode. In other words, in the normal processing mode, the lens is rotated at a speed of 1.5 to 2 times compared to the soft mode in a case where the processing conditions of the lens are the same. Thereby, in the normal processing mode, the processing time of the roughing is shortened while suppressing the "axis deviation".

In the above, in the first stage of the roughing of the plastic lens, the lens LE is moved until the rough grindstone 162 reaches the roughing path RT. However, since the lens LE is not rotated, a force that draws the lens LE into the grindstone side does not act easily, and occurrence of the "axis deviation" is little empirically. However, if the amount of processing increases as the lens LE is cut, and the movement speed of the lens LE in the Y-axis direction becomes too fast, the "axis deviation" may occur. Accordingly, when the lens LE is cut without being rotated, it is preferable to apply the above method to the movement control of the lens LE in the Y-axis direction. That is, the processing volume at every unit distance by which the lens LE is moved in the Y-axis direction is obtained based on the condition data including the roughing path, the curve shape of the lens front and rear surfaces, the lens external diameter, the diameter of the roughing tool, and the rotational direction of the roughing tool, and the processing load and the load torque applied to the lens chuck shafts are obtained based on the obtained processing volume. The movement speed of the lens LE in the Y-axis direction is calculated so that the load torque per unit time does not exceed a predetermined reference value, and thereby, the motor of the Y-axis direction movement unit is controlled.

Processing can be more efficiently performed while suppressing an occurrence of the axis deviation of the lens LE by the control of the roughing described above, in contrast with Patent Documents 1 and 2 mentioned in the Background Art. Since the technique of Patent Document 2 is the control in which the amount that is cut during roughing is approximately constant, the rotation number of the lens tends to increase, and the processing time tends to become long. Additionally, since there is no information on the thickness of the lens that changes in a cutting position, if the thickest lens is supposed, and a very small amount that is cut is adopted in expectation of safety so that the "axis deviation" does not occur, the processing time becomes longer. Since the amount of cut is constant, the load torque applied to the lens chuck shafts may exceed a permissible value in a thick portion of the lens. Moreover, in a processing stage of the outer peripheral portion of the lens that is apart from the chuck center, there is a problem that noise is apt to be generated during processing. In order to suppress an occurrence of the noise, the processing time becomes longer if the rotating speed of a lens is made slow. In the apparatus of the present invention, these improvements can be achieved, and the lens is processed in a state where the lens is cut to the neighborhood of the chuck center from an initial stage, generation of the noise can also be suppressed.

The present invention is not limited to the above, and the following various modifications can be made. As for the lens external diameter data, it is preferable to measure a lens to be actually processed, using the lens external diameter detector 500, or to input the data, using an input unit that constitutes the display 60. However, in an apparatus that does not have the measurement unit and the input unit for the lens external diameter, the external diameter DR1 of a standard lens is stored in advance in the memory 51, and the control unit 50 may obtain the load torque TAn at every rotation angle of the lens LE based on this. For example, 75 mm in diameter is stored in the memory 51 as the external diameter DR1 of the standard lens.

In a case where the lens to be actually processed has a diameter approximately equal to or smaller than the external diameter DR1 of the lens stored in the memory 51, roughing with suppressed "axis deviation" can be performed by the control of the rotating speed of the lens based on the load torque TAn and the rotating speed SPn that are obtained as described above. In a case where the lens to be actually processed has a diameter greater than the external diameter DR I of the lens stored in the memory 51, the "axis deviation" may occur even in the control of the rotating speed of the lens based on the load torque TAn. In the case, the following may be performed.

In the roughing of the second stage, the rotation load to be actually applied to the lens by the roughing tool is detected. This rotation load can be detected when the control unit 50 detects the load current of at least one of the motor 160 that the grindstone rotary unit has and the motor 120 of the lens rotary unit (the control unit 50 doubles as a load detector). The control unit 50 monitors this load current. In a case where the detected load exceeds a predetermined value TO (this value is experimentally determined and stored in the memory 51) set in order to suppress occurrence of the "axis deviation", the rotating speed SPn of the lens is lowered so that the detected load does not exceed the predetermined value TO. If the detected load is made to fall below the predetermined value TO, the motor 120 is again controlled based on the rotating speed SPn.

Additionally, in a case where the detected load exceeds the predetermined value TO, it is predicted that the diameter of the actual lens is greater than the external diameter DR1. Therefore, the control unit 50 can correct the rotating speed SPn by a predetermined method based on this result. For example, the control unit 50 assumes that the actual lens has an external diameter DR2 (85 mm in diameter) greater than the external diameter DR1 (75 mm in diameter), the load torque TAn is again calculated based on the external diameter DR2, and the rotating speed SPn of the lens is obtained.

The control unit 50 controls the subsequent rotation of the lens based on the rotating speed SPn after the correction.

Moreover, at least the external diameter DR1 and the external diameter DR2 greater than this are stored in the memory 51 as the external diameter of the lens, and the control unit 50 obtains a first rotating speed SPn1 based on the external diameter DR1 and a second rotating speed SPn2 based on the external diameter DR2. Also, the control unit 50 rotates the lens based on the first rotating speed SPn1 in an early stage of the roughing of the second stage, and switches the rotating speed of the lens to a control based on the second rotating-speed SPn2 in a case where the load detected by the load detector exceeds the predetermined value TO. The "axis deviation" can be suppressed even by this to perform efficient processing, compared to the related art.

Additionally, the control method of lowering the rotating speed SPn of the lens so that the load detected by the load detector does not exceed the predetermined value TO as described above can further reduce occurrence of the "axis deviation" even when being applied to a case where the external diameter of the actual lens is measured or input.

Additionally, as the input unit for the external diameter of the lens, a configuration in which a selection can be made from a plurality of gradual values like 65 mm in diameter, 75 mm in diameter, and 85 mm in diameter may be adopted as a modification example of a configuration in which data of the lens external diameter measured by a vernier caliper or viewing is input by the display 60.

As described above, various modifications can be made to the invention, and these are included in the present invention within the scope where technical ideas are made the same.

What is claimed is:

1. An eyeglass lens processing apparatus for processing a periphery of an eyeglass lens, the eyeglass lens processing apparatus comprising:

a lens rotating unit configured to rotate a lens chuck shaft for holding the eyeglass lens;

a tool rotating unit configured to rotate a tool spindle to which a roughing tool for roughing the periphery of the eyeglass lens is attached;

a moving unit configured to move the lens chuck shaft relative to the tool spindle;

a controller configured to control the lens rotating unit and the moving unit based on a roughing path, which includes a finishing margin relative to a target lens shape, for roughing the periphery of the eyeglass lens by the roughing tool, such that the roughing tool cuts the periphery of the eyeglass lens up to the roughing path without rotating the eyeglass lens in a first stage and the roughing tool moves along the roughing path while rotating the eyeglass lens in a second stage; and a calculating unit configured to calculate control data of the lens rotating unit at the second stage, wherein the calculating unit is configured to determine a first load torque to be applied to the lens chuck shaft at every rotation angle of the lens based on condition data including the roughing path, thickness at a radial position of the lens around a chuck center of the lens chuck shaft and a diameter of the roughing tool, and obtains a rotation speed of the lens at which the first load torque per unit time becomes equal to or lower than a reference value, and wherein after the roughing tool cuts the periphery of the eyeglass lens up to the roughing path in the first stage, the processing controller is configured to change from the first stage to the second stage and the roughing tool starts roughing the periphery of the eyeglass lens from a position where the roughing tool has cut the periphery of the eyeglass lens up to the roughing path in the first stage.

2. The eyeglass lens processing apparatus according to claim 1, wherein the calculating unit divides a processing region at every rotation angle of the lens into a plurality of regions by a predetermined calculation method, obtains a second load torque at every one of the plurality of regions based on the condition data, and obtains the first load torque at every rotation angle of the lens by integrating the obtained second load torque.

3. The eyeglass lens processing apparatus according to claim 1, wherein the calculating unit obtains a processing load applied to a force point determined by a predetermined method for the processing region at every rotation angle of the lens, and a direction of the processing load based on the condition data, and obtains the first load torque based on the distance from the chuck center of the lens chuck shafts to the force point, the processing load, and the direction of the processing load.

4. The eyeglass lens processing apparatus according to claim 2, wherein the calculating unit obtains an amount of processing at every one of the plurality of regions roughed based on the condition data, obtains a processing load that is generated by the rotation of the roughing tool based on the processing amounts, and obtains the second load torque at every one of the plurality of regions based on the distance from the chuck center of the lens chuck shafts to the respective one of the plurality of regions, the processing load.

5. The eyeglass lens processing apparatus according to claim 1, further comprising:

lens surface shape obtaining unit for obtaining a front surface shape and a rear surface shape of the lens; and a lens external diameter obtaining unit configured to obtain an external diameter of the lens, and wherein the calculating unit obtains the thickness at the radial position of the lens based on the front surface shape and the rear surface shape of the lens obtained by the lens surface shape obtaining unit and the external diameter of the lens obtained by the lens external diameter obtaining unit.

6. The eyeglass lens processing apparatus according to claim 5, wherein the lens external diameter obtaining unit includes a storage unit for storing an external diameter which has been set in advance.

7. The eyeglass lens processing apparatus according to claim 1 further comprising:

a load detector configured to detect a rotation load applied to the lens by the roughing tool, wherein when the load detected by the load detector exceeds a value set in order to suppress an occurrence of axis deviation, the controller controls the rotating speed of the lens rotating unit so that the rotation load does not exceed the value.

8. The eyeglass lens processing apparatus according to claim 1, a load detector configured to detect a rotation load applied to the lens by the roughing tool, wherein when the load detected by the load detector exceeds a value set in order to suppress an occurrence of axis deviation, the controller corrects a rotating speed obtained by the calculating unit by a predetermined method, and controls the lens rotating unit based on the corrected rotating speed.

9. The eyeglass lens processing apparatus according to claim 1, wherein the controller controls the lens rotating unit so as not to exceed an upper speed limit set in order to prevent damage of the lens at least in a second half of one rotation of the lens.

10. The eyeglass lens processing apparatus according to claim 1, further comprising mode selection unit for selecting a first mode when a water-repellant lens is processed and a second mode when a normal lens is processed, wherein the reference value applied when the second mode is selected is set to be higher than that when the first mode is selected.

11. The eyeglass lens processing apparatus according to claim 1, wherein the first stage and the second stage is a single continuous step in which the roughing tool is not separated from the lens during the continuous step.

12. An eyeglass lens processing apparatus for processing a periphery of an eyeglass lens, the eyeglass lens processing apparatus comprising:

a lens rotating unit configured to rotate a lens chuck shaft configured to hold the eyeglass lens;

a tool rotating unit configured to rotate a tool spindle to which a roughing tool for roughing the periphery of the eyeglass lens is attached;

a moving unit configured to move the lens chuck shaft relative to the tool spindle;

a controller configured to control the lens rotating unit and the moving unit and configured to rough the periphery of the eyeglass lens by the roughing tool based on a roughing path, which includes a finishing margin relative to a target lens shape, such that the roughing tool cuts the periphery of the eyeglass lens up to the roughing path without rotating the eyeglass lens in a first stage and then while the lens is rotated in a second stage; and a calculating unit configured to calculate control data of the lens rotating unit at the second stage, wherein the calculating unit is configured to determine a first load torque to be applied to the lens chuck shaft at every rotation angle of the lens based on condition data including the roughing path, thickness at a radial position of the lens around a chuck center of the lens chuck shaft and a diameter of the roughing tool, and is configured to obtain a rotation speed of the lens at which the first load torque per unit time becomes equal to or lower than a reference value.

13. The eyeglass lens processing apparatus according to claim 12, wherein the calculated load torque to be applied to the lens increases as a distance between a center of the lens chuck shaft and a processed point of the lens increases.

14. An eyeglass lens processing apparatus for processing a periphery of an eyeglass lens, the eyeglass lens processing apparatus comprising:

a lens rotating unit configured to rotate a lens chuck shaft for holding the eyeglass lens;

a tool rotating unit configured to rotate a tool spindle to which a roughing tool for roughing the periphery of the eyeglass lens is attached;

a moving unit configured to move the lens chuck shaft relative to the tool spindle; and a controller configured to control the lens rotating unit and the moving unit based on a roughing path, which includes a finishing margin relative to a target lens shape, for roughing the periphery of the eyeglass lens by the roughing tool, such that the roughing tool cuts the periphery of the eyeglass lens up to the roughing path without rotating the eyeglass lens in a first stage and the roughing tool moves along the roughing path while rotating the eyeglass lens in a second stage, wherein, after the roughing tool cuts the periphery of the eyeglass lens up to the roughing path in the first stage, the processing controller is configured to change from the first stage to the second stage and the roughing tool starts roughing the periphery of the eyeglass lens from a position where the roughing tool has cut the periphery of the eyeglass lens up to the roughing path in the first stage.

* * * * *